US008651365B2

(12) United States Patent
Lymn et al.

(10) Patent No.: US 8,651,365 B2
(45) Date of Patent: Feb. 18, 2014

(54) COVER FOR A BOX CONTAINING A FLUID

(75) Inventors: Kimberly J. Lymn, Long Lake, MN (US); Holly A. Robbins, Minneapolis, MN (US); Kelly N. Esterby, Hudson, WI (US); Gary L. Sotebeer, Savage, MN (US); CarolAnn M. Sylvester, Lake Shore, MN (US)

(73) Assignee: Target Brands, Inc., Minneapolis, MN (US)

( * ) Notice: Subject to any disclaimer, the term of this patent is extended or adjusted under 35 U.S.C. 154(b) by 1097 days.

(21) Appl. No.: 12/024,301

(22) Filed: Feb. 1, 2008

(65) Prior Publication Data

US 2009/0194172 A1 Aug. 6, 2009

(51) Int. Cl.
*B65D 25/34* (2006.01)
*B65D 25/28* (2006.01)

(52) U.S. Cl.
USPC ..... 229/117.3; 220/212.5; 220/309.1; 206/459.5; 137/343

(58) Field of Classification Search
USPC ..... 137/343; 220/309.1, 495.05; 229/117.3; 206/831
See application file for complete search history.

(56) References Cited

U.S. PATENT DOCUMENTS

| | | | | | |
|---|---|---|---|---|---|
| 310,241 | A | * | 1/1885 | Arthur | 229/125.19 |
| 1,116,043 | A | * | 11/1914 | Elliot | 229/125.37 |
| 3,119,544 | A | * | 1/1964 | Cope et al. | 229/117.16 |
| 3,160,326 | A | | 12/1964 | Sturdevant | |
| 3,349,986 | A | * | 10/1967 | Chapman et al. | 229/117.3 |
| 3,363,807 | A | | 1/1968 | Powell | |
| 3,371,824 | A | | 3/1968 | Goss | |
| D231,787 | S | | 6/1974 | Burnley | |
| 4,042,110 | A | * | 8/1977 | Guernsey | 206/459.1 |
| 4,475,670 | A | | 10/1984 | Rutter | |
| 4,699,342 | A | | 10/1987 | Bartz et al. | |
| 4,815,631 | A | | 3/1989 | Eeg et al. | |
| 4,850,506 | A | * | 7/1989 | Heaps et al. | 229/117.3 |
| RE33,128 | E | | 12/1989 | Nordstrom | |
| 4,927,042 | A | * | 5/1990 | Ring | 220/23.83 |
| 4,934,654 | A | | 6/1990 | Linnemann | |
| D315,078 | S | | 3/1991 | Nikolaiczyk et al. | |
| D321,647 | S | | 11/1991 | Oldorf | |
| 5,074,462 | A | * | 12/1991 | Countee, Jr. | 229/155 |
| 5,085,346 | A | | 2/1992 | Wright | |
| D328,429 | S | | 8/1992 | Ben-Uri | |
| D331,683 | S | | 12/1992 | Koester | |
| 5,228,589 | A | * | 7/1993 | Della Riva | 206/229 |
| 5,249,827 | A | * | 10/1993 | Olson | 283/36 |
| 5,348,186 | A | | 9/1994 | Baker | |
| 5,454,492 | A | | 10/1995 | Hunter et al. | |
| 5,462,168 | A | * | 10/1995 | Oberhelman et al. | 206/457 |
| 5,735,429 | A | | 4/1998 | Whitworth | |

(Continued)

*Primary Examiner* — Gary Elkins
*Assistant Examiner* — Christopher Demeree
(74) *Attorney, Agent, or Firm* — Leanne Taveggia Farrell; Westman, Champlin & Koehler, P.A.

(57) ABSTRACT

A cover for a box containing a fluid includes a top panel with a tuck flap. A perforated end of the tuck flap is coupled to a detachable attachment along a perforated line. The attachment includes instructions for forming the cover and also includes user-fillable labels. When the cover is in an assembled state, the perforated line forms a perforated edge that is tucked between panels of the cover and therefore hidden from view. A front panel of the cover includes an opening having edges. At least portions of the edges are inserted into a peripheral slot of a spigot that is coupled to a bladder contained in the box to provide additional support to the spigot and secure the cover to the box.

23 Claims, 14 Drawing Sheets

(56) References Cited

U.S. PATENT DOCUMENTS

| | | | | |
|---|---|---|---|---|
| 5,749,489 | A | 5/1998 | Benner et al. | |
| 5,826,752 | A | 10/1998 | Latimer | |
| D402,845 | S | 12/1998 | Hanzok | |
| 6,098,798 | A * | 8/2000 | Abbott et al. | 206/321 |
| D435,758 | S | 1/2001 | Evers | |
| 6,334,329 | B1 | 1/2002 | Weller | |
| 6,412,663 | B1 | 7/2002 | Adamson, II et al. | |
| 6,786,394 | B2 | 9/2004 | Prince | |
| D502,360 | S | 3/2005 | Kautz | |
| 7,263,790 | B2 | 9/2007 | Richards | |
| D590,656 | S | 4/2009 | Patti et al. | |
| 2005/0236464 | A1 * | 10/2005 | Cohen | 229/116 |
| 2007/0164092 | A1 | 7/2007 | Biundo | |
| 2007/0228123 | A1 * | 10/2007 | McKenna et al. | 229/117.13 |
| 2007/0228127 | A1 | 10/2007 | Gardner | |

* cited by examiner

COVER FOR A BOX CONTAINING A FLUID

BACKGROUND

Recently, there has been a shift to packaging wine in a bag and enclosing the bag in a box for protection and support. In general, the bag is made of plastic while the box is made of a corrugated cardboard. Attached to the bag is a spigot used to dispense wine from within the bag. Typically, the spigot is accessed by tearing away a perforated section of the box to form an aperture in the box. The spigot is pulled through the aperture so that the spigot protrudes from an outer surface of the box. The spigot includes a valve that can be manipulated to control the flow of wine from the bag.

Decorative covers have been developed that can be placed over the box to change the appearance of the box. Generally, covers for boxed wine use some sort of non-aesthetic locking mechanism to secure the cover to the boxed wine. Another result of covering box wine is that identification of the varietal or brand of wine is hidden from view.

The discussion above is merely provided for general background information and is not intended to be used as an aid in determining the scope of the claimed subject matter.

SUMMARY

A cover for a box containing a fluid includes a top panel with a tuck flap. A perforated end of the tuck flap is coupled to a detachable attachment along a perforated line. The attachment includes instructions for forming the cover and also includes user-fillable labels. When the cover is in an assembled state, the perforated line forms a perforated edge that is tucked between panels of the cover and therefore hidden from view. A front panel of the cover includes an opening having edges. At least portions of the edges are inserted into a peripheral slot of a spigot that is coupled to a bladder contained in the box to provide additional support to the spigot and secure the cover to the box.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Embodiments described herein include sheet material formable into an aesthetically pleasing cover for boxes containing beverages, such as boxed wine. The cover includes an open bottom and an opposing top panel having a tuck flap. Coupled to the tuck flap is a unique detachable attachment including instructions for forming the carton, as well as user-fillable labels for mounting to the cover. After the attachment is detached, the perforated edges are hidden from view when the tuck flap is tucked between side panels and a back panel of the cover. A front panel of the cover includes an opening for accommodating a spigot of the boxed beverage. At least portions of the edges of the opening are secured into a peripheral slot of the spigot to both secure the cover to the box beverage as well as provide additional support to the spigot.

Figure 1:
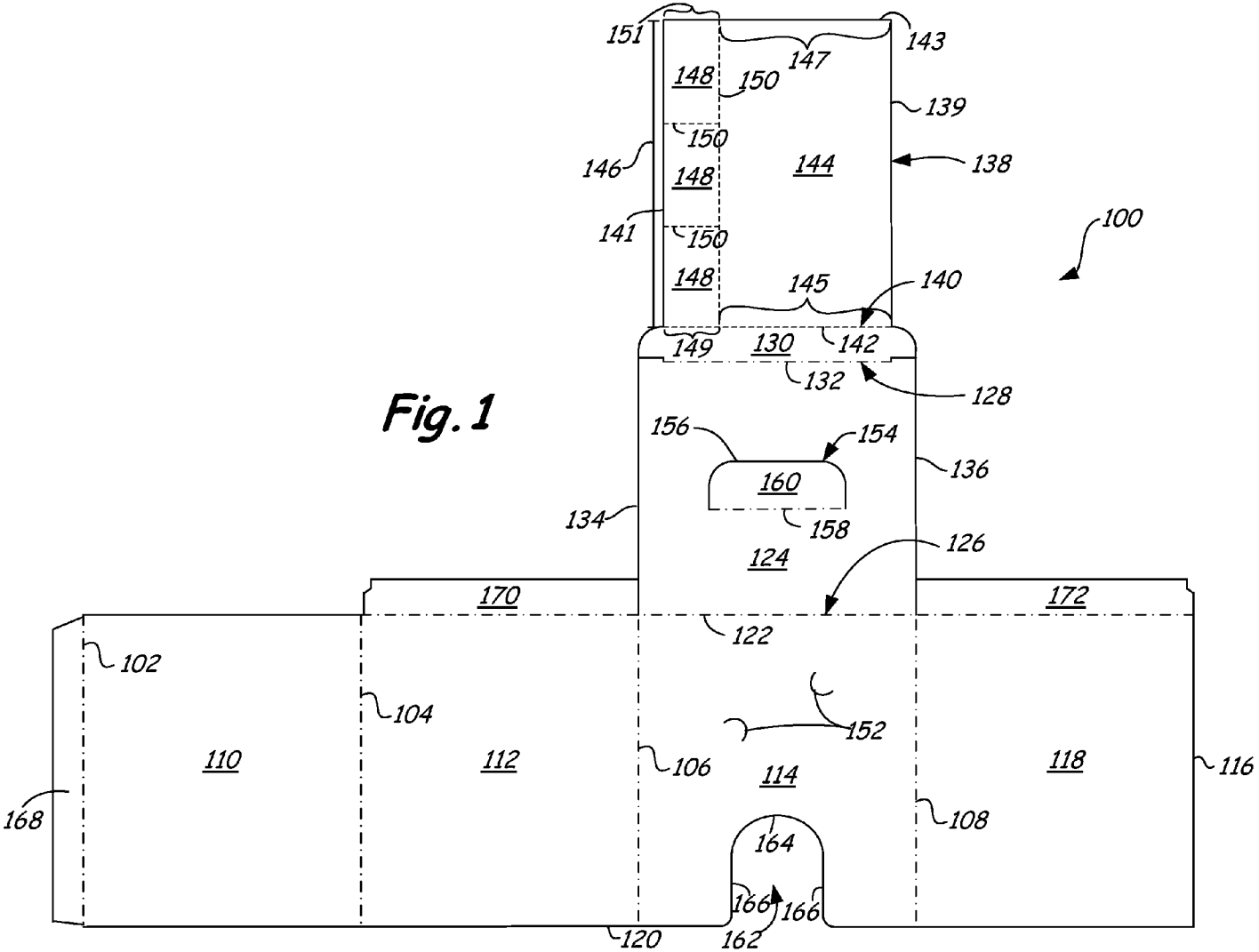
FIG. 1 illustrates a plan view of a sheet material formable into a cover for a box containing a beverage under one embodiment.

FIG. 1 is a plan view of a sheet material 100 formable into a cover 101 (FIG. 2) for a box containing a beverage under one embodiment. Sheet material 100 includes a first score 102, a second score 104, a third score 106 and a fourth score 108. Second score 104 is spaced apart from and substantially parallel with first score 102 to define a back panel 110. Third score 106 is spaced apart from and substantially parallel with second score 104 to define a first side panel 112. Fourth score 108 is spaced apart from and substantially parallel with third score 106 to define a front panel 114. Sheet material 100 includes a side panel free edge 116. Side panel free edge 116 is spaced apart from and substantially parallel with fourth score 108 to define a second side panel 118.

A bottom free edge 120 is substantially perpendicular and intersecting with first, second, third and fourth scores 102, 104, 106 and 108 to define a bottom of back panel 110, first side panel 112, front panel 114 and second side panel 118. A top edge score 122 is substantially perpendicular with the first, second, third and fourth scores 102, 104, 106 and 108 to define a top of first side panel 112, front panel 114 and second side panel 118. Although not illustrated, in other embodiments, it should be realized that top edge score 122 can also define a top of back panel 110. In still other embodiments, top edge score 122 need only define a top of one of back panel 110, first side panel 112, front panel 114 and second side panel 118 so a top panel 124 can be fixed to the top of one of back panel 110, first side panel 112, front panel 114 and second side panel 118 at top score 122. As illustrated in the embodiment of FIG. 1, top panel 124 is fixed to the top of front panel 114 at top score 122.

Opposite a fixed end 126 of top panel 124, top panel 124 includes a tuck flap end 128 coupled to a tuck flap 130 at a tuck flap score 132. It should be realized that in other embodiments tuck flap 130 can be coupled to other ends of top panel 124, such as a first top panel side edge 134 or second top panel side edge 136. First top panel side edge 134 and second top panel side edge 136 extend between fixed end 126 and tuck flap end 128.

Sheet material 100 also includes a detachable attachment 138. Detachable attachment 138 is attached to a perforated end 140 of tuck flap 130 at a perforated attachment line 142 and is defined by at least four edges including a first side edge 139, a second side edge 141, perforated attachment edge or line 142 and a distal edge 143. Perforated attachment line 142 is substantially parallel with tuck flap score 132. Attachment 138 includes an instructions section 144 and a labels section 146. Instructions section 144 includes indicia indicative of forming sheet material 100 into a cover 101 for boxes containing beverages and is defined at least by one of the first and second side edges 139 and 141 of detachable attachment 138, a portion 145 of the perforated attachment edge or line 142 and a portion 147 of distal edge 143. Instructions section 144 also includes indicia indicative of bar code information, distribution information, brand name information and other types of information essential for product distribution. Labels section 146 includes a plurality of labels 148 and is defined at least by the other of the first and second side edges 139 and 141 of detachable attachment 138, a remaining portion 149 of the perforated attachment edge or line 142 and a remaining portion 151 of distal edge 143. Labels 148 are coupled to each other and to instructions section 144 at label perforation lines 150.

Upon detaching attachment 138 at perforated attachment line 142, labels 148 can be detached from instructions section 144. Each label 148 can be written on by a user for the purpose of adding text to cover 101. In one embodiment, label 148 can include text that indicates the beverage type for the beverage in the box that sheet material 100 will cover. For example, labels 148 can indicate a particular variety of wine. In another embodiment, each label 148 can be written on to include a message. Regardless of what type of information is related on labels 148, each label can be inserted into a pair of label die cuts 152 located on front panel 114. Although label die cuts 152 are illustrated as half circle cuts in sheet material 100, label die cuts 152 can take any geometrical form. In addition, although a pair of die cuts 152 are illustrated in FIG. 1, any number of die cuts can be included as long as label 148 can be held in place on front panel 114. As illustrated in the embodiment of FIG. 1, detachable attachment 138 includes three labels 148 in label section 146. However, it should be realized that any number of labels can be formed in label section 146 of attachment 138 as long as the position of die cuts 152 conforms to the size of labels 148.

Front panel 114 of sheet material 100 includes a spigot opening 162. Spigot opening 162 is defined by spigot opening edges, such as a top edge 164 and a pair of side edges 166. Side edges 166 are substantially perpendicular or intersecting with bottom edge 120, and top edge 164 is a radial edge that couples the side edges 166 together.

Top panel 124 of sheet material 100 includes a handle opening 154 for accessing a handle located on a box containing a beverage. Handle opening 154 includes a handle die cut 156 and a handle score 158. Handle die cut 156 and handle score 158 define a handle flap 160. It should be understood that other forms of an opening for accessing a handle are possible.

As also illustrated in the embodiment of FIG. 1, sheet material 100 includes a glue flap 168, a first inner flap 170 and a second inner flap 172. Glue flap 168 is coupled to back panel 110 at first score 102. Glue flap 168 is configured for receiving an adhesive so back panel 110 can be adhesively assembled into a position adjacent second side panel 118. In particular, side panel free edge 116 should come into alignment with first score 102 when glue flap 168 is adhesively attached to the interior of side panel 218. It should be realized that in the alternative, glue flap 168 can be coupled to a different one of panels 112, 114 and 118 depending on the particular layout of sheet material 100. For example, glue flap 168 can be coupled to second side panel 118 at side panel free edge 116 so second side panel 118 can be adhesively assembled into a position adjacent back panel 110.

Figure 2:
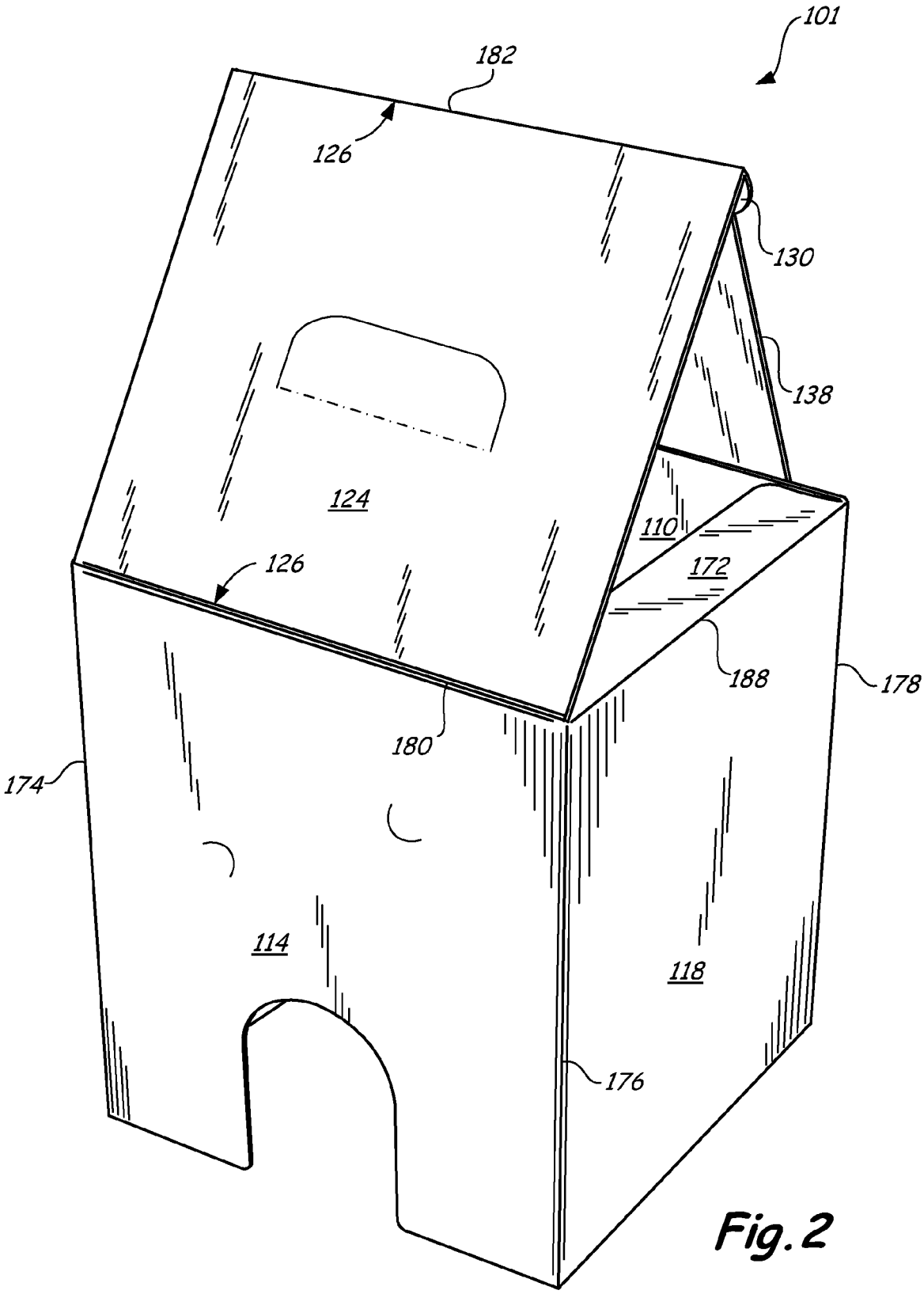
FIG. 2 illustrates a perspective view of the cover formed with the sheet material illustrated in FIG. 1 in a partially assembled state.
Figure 3:
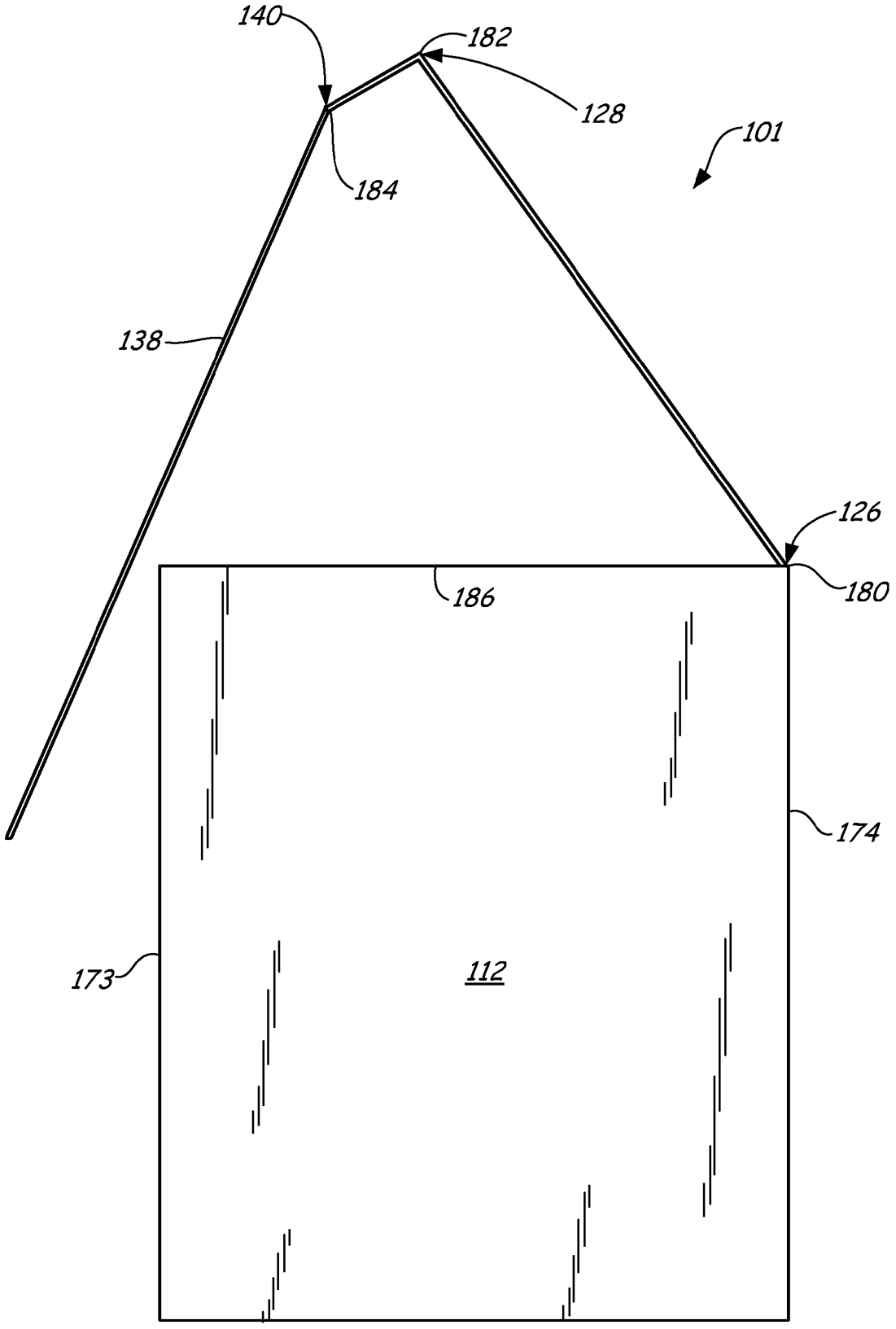
FIG. 3 illustrates a side view of the cover as illustrated in FIG. 2.
Figure 4:
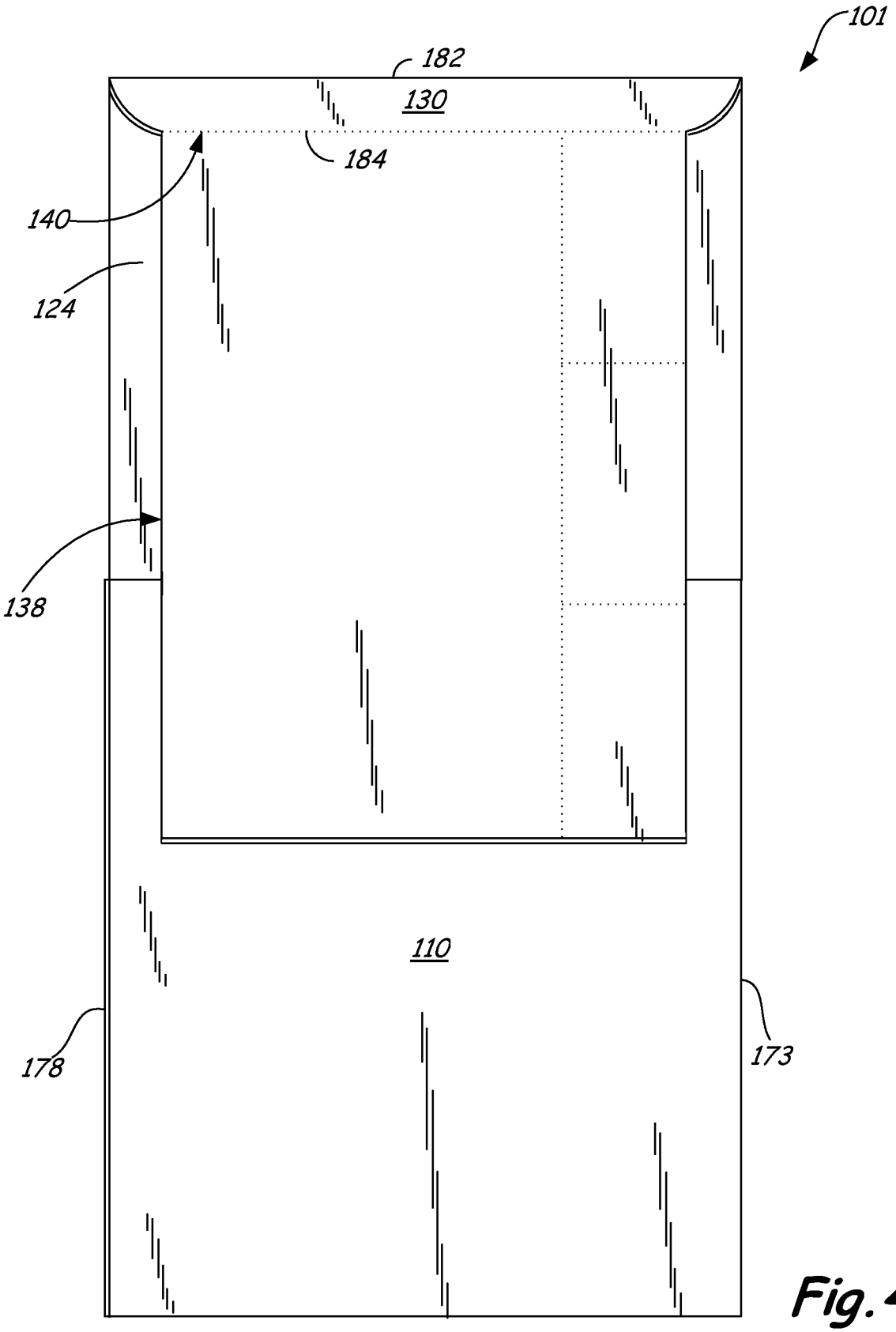
FIG. 4 illustrates a back view of the cover as illustrated in FIGS. 2 and 3.

FIGS. 2-4 illustrate a perspective view, a side view and a back view, respectively, of a cover 101 for a box containing a beverage under one embodiment. More particularly, FIGS. 2-4 illustrate a cover 101 for box wine. In FIGS. 2-4 cover 101 is formed from sheet material 100 in a partially assembled state. Cover 101 includes front panel 114 (FIG. 2) and opposing back panel 110 (FIGS. 2 and 4) and second side panel 118 (FIG. 2) and an opposing first side panel 112 (FIG. 3). First side panel 112 and opposing second side panel 118 couple back panel 110 to front panel 114. When sheet material 100 is folded at second score 104 (FIG. 1), a second score edge 173 (FIGS. 3 and 4) is formed. When sheet material 100 (FIG. 1) is folded at third score 106 (FIG. 1), a third score edge 174 (FIGS. 2 and 3) is defined. When sheet material 100 is folded at fourth score 108 (FIG. 1), a fourth score edge 176 (FIG. 2) is defined. When glue flap 168 (FIG. 1) is folded at first score 102 (FIG. 1) and adhesively coupled to second side panel 118, a first score edge 178 (FIGS. 2 and 4) is defined.

Cover 101 includes top panel 124 (FIGS. 2 and 4) configured to coordinate with front panel 114, back panel 110, first side panel 112 and second side panel 118 to enclose the top of cover 101. In FIGS. 1-3, fixed end 126 of top panel 124 is coupled to front panel 114 at top score 122 (FIG. 1). However, as previously indicated, top panel 124 can be fixed to a different one of the panels. When sheet material 100 (FIG. 1) is folded at top score 122, a top score edge 180 (FIGS. 2 and 3) is defined. Tuck flap 130 (FIGS. 2 and 4) is fixed to tuck flap end 128 (FIG. 2) of top panel 124 at tuck flap score 132 (FIG. 1). When sheet material 100 is folded at tuck flap score 132, a tuck flap score edge 182 (FIGS. 2-4) is defined. Detachable attachment 138 (FIGS. 1-4) is attached to perforated end 140 (FIGS. 3 and 4) of tuck flap 130 at attachment perforation line 142 (FIG. 1) to define an attachment edge 184. Upon detachment of attachment 138, perforated end 140 will have a rough edge. Features of front panel 114, top panel 124 and detachable attachment 138 were discussed in detail above in regards to FIG. 1.

Figure 5:
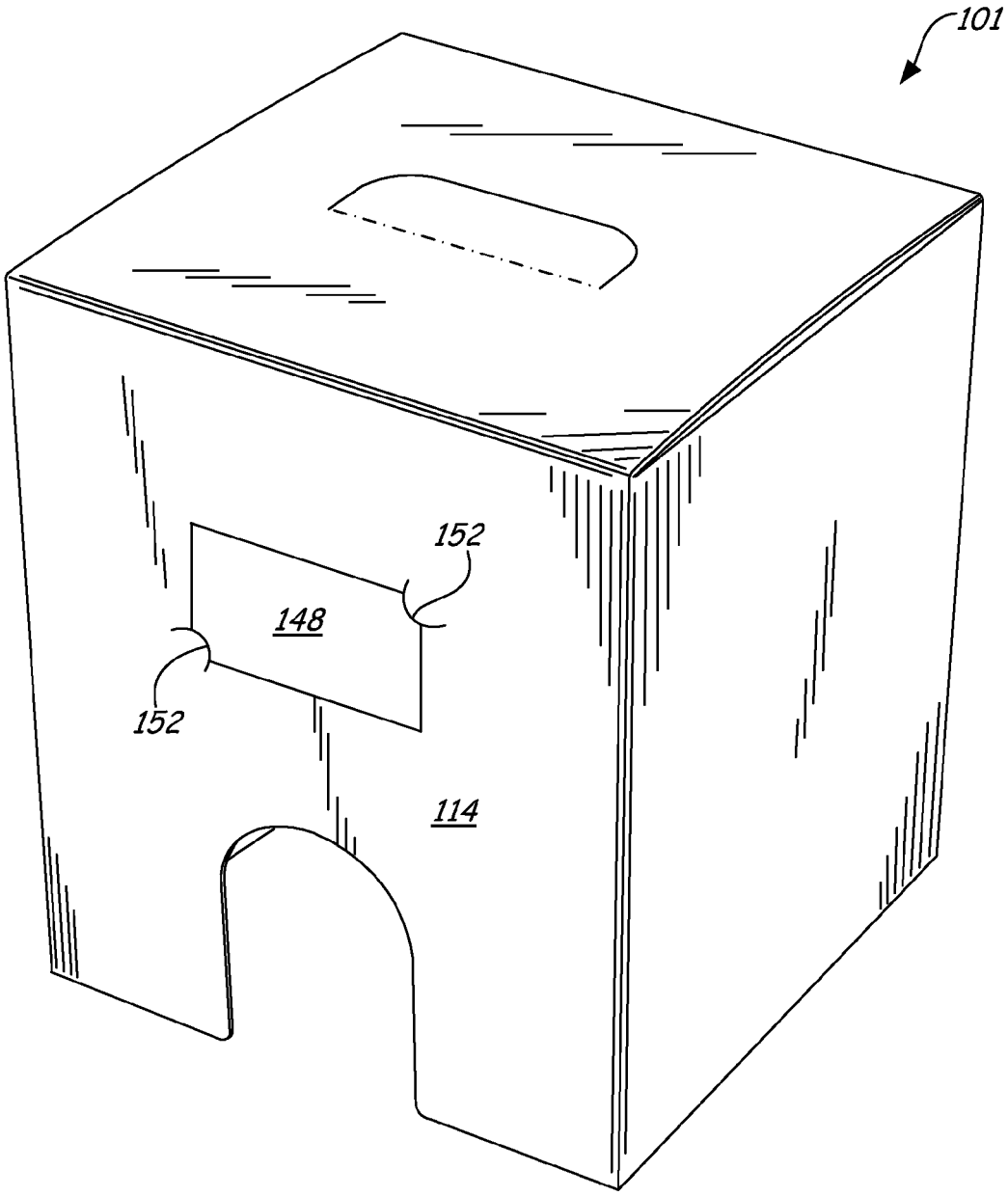
FIG. 5 illustrates a perspective view of the cover in its final formed state with the sheet material illustrated in FIG. 1.
Figure 6:
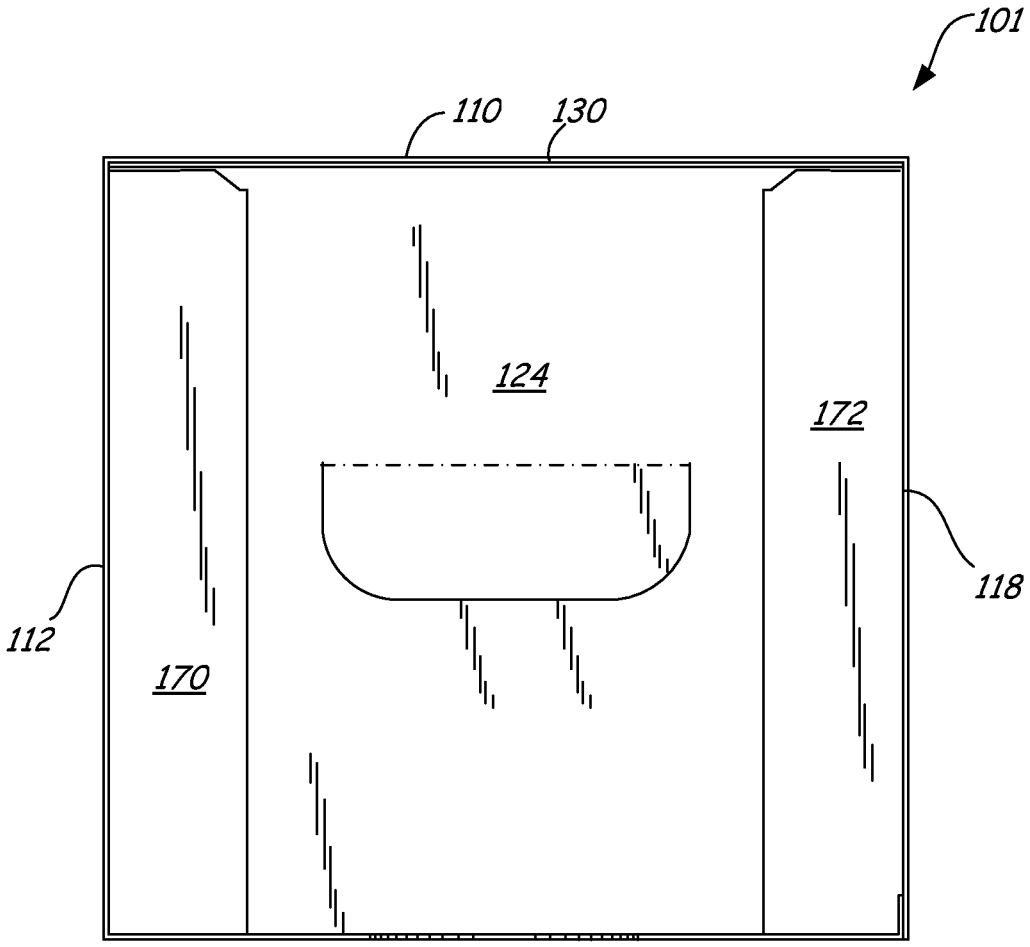
FIG. 6 illustrates a bottom view of the cover as illustrated in FIG. 5.

FIG. 5 illustrates a perspective view and FIG. 6 illustrates a bottom view of cover 101 shown in a fully assembled state forming a sleeve with a closed top and an open bottom. In FIG. 5, one of the labels 148 of detachable attachment 138 (FIG. 1) is shown inserted into and held in place in label die cuts 152 of front panel 114. In FIG. 6, tuck flap 130 coupled to top panel 124 is illustrated as being tucked in between first side panel 112, second side panel 118 and back panel 110. In addition, tuck flap 130 is also illustrated as being in contact with first inner flap 170 and second inner flap 172 that are coupled to first side panel 112 and second side panel 118, respectively. Tuck flap 130 is positioned in a plane perpendicular with a plane of first and second inner flaps 170 and 172.

First inner flap 170 (FIG. 1) is fixed to first side panel 112 at top edge score 122 and second inner flap 172 (FIGS. 1 and 2) is fixed to a second side panel 118 at top edge score 122. Tuck flap 130 interlocks with first and second inner flaps 170 and 172 to keep first side panel 112, second side panel 118, front panel 114, back panel 110 and top panel 124 in position to form a sleeve. By interlocking the first and second inner flaps 170 and 172 with tuck flap 130, the rough, perforated end 140 is tucked between panels of the cover and hidden from view. As previously discussed, first inner flap 170 and second inner flap 172 can be located in different positions. When sheet material 100 is folded at top score 122 adjacent first side panel 112, a first inner flap edge 186 (FIG. 3) is defined. When sheet material 100 is folded at top score 122 adjacent second side panel 118, a second inner flap edge 188 (FIG. 2) is defined.

Cover 101 formed of sheet material 100 illustrated in FIGS. 1-6 is generally configured to house a box containing about 1.5 liters of beverage. While a variety of different dimensions can be utilized, example panel dimensions include a back panel 110 and front panel 114 having a width between first score 102 and second score 104 and a width between third score 106 and fourth score 108 of about 12.54 cm. Further, first side panel 112 and second side panel 118 include a width between second score 104 and third score 106 and a width between fourth score 106 and side panel free edge 116 of about 12.07 cm. A distance between top score 122 and tuck flap score 132 of top panel 124 is about 12.07 cm while detachable attachment 138 is about 10.16 cm by 15.24 cm. Of course, as previously discussed, cover 101 formed of sheet material 100 can include other dimensions and can cover a box of a variety of different volumes.

Figure 7:
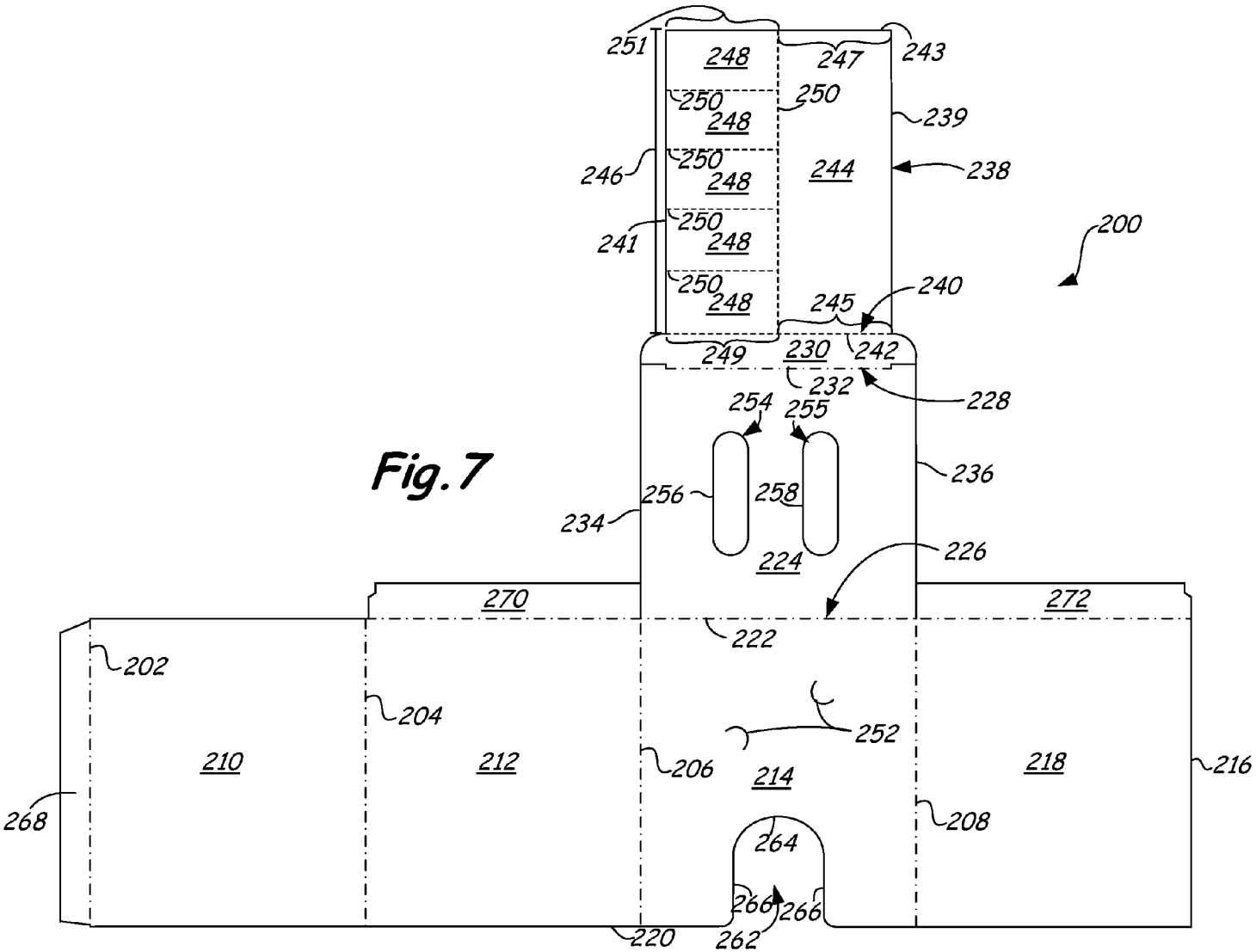
FIG. 7 illustrates a plan view of a sheet material formable into a cover for a box containing a beverage under another embodiment.

FIG. 7 is a plan view of a sheet material 200 formable into a cover 201 (FIG. 8) for a box containing beverages under another embodiment. Like sheet material 100 of FIG. 1, sheet material 200 includes a first score 202, a second score 204, a third score 206 and a fourth score 208. Second score 204 is spaced apart from and substantially parallel with first score 202 to define a back panel 210. Third score 206 is spaced apart from and substantially parallel with second score 204 to define a first side panel 212. Fourth score 208 is spaced apart from and substantially parallel with third score 206 to define a front panel 214. Sheet material 200 includes a side panel free edge 216. Side panel free edge 216 is spaced apart from and substantially parallel with fourth score 208 to define a second side panel 218.

A bottom free edge 220 is substantially perpendicular and intersecting with first, second, third and fourth scores 202, 204, 206 and 208 to define a bottom of back panel 210, first side panel 212, front panel 214 and second side panel 218. A top score 222 is substantially perpendicular with the first, second, third and fourth scores 202, 204, 206 and 208 to define a top of first side panel 212, front panel 214 and second side panel 218. As previously discussed in regards to FIG. 1, although not particularly illustrated, in other embodiments, it should be realized that top score 222 can also define a top of back panel 210. In still other embodiments, top score 222 need only define a top of one of back panel 210, first side panel 212, front panel 214 and second side panel 218 so a top panel 224 is fixed to the top of one of back panel 210, first side panel 212, front panel 214 and second side panel 218 at top edge score 222. As illustrated in the embodiment of FIG. 2, top panel 224 is fixed to the top of front panel 214 at top score 222.

Opposite a fixed end 226, top panel 224 includes a tuck flap end 228 coupled to a tuck flap 230 at a tuck flap score 232. It should be realized that in other embodiments tuck flap 230 can be coupled to other free ends of top panel 224, such as a first top panel side edge 234 or second top panel side edge 236. First top panel side edge 234 and second top panel side edge 236 extend between fixed end 226 and tuck flap end 228.

Sheet material 200 also includes a detachable attachment 238. Detachable attachment 238 is attached to a perforated end 240 of tuck flap 230 at a perforated attachment line 242 and is defined by at least four edges including a first side edge 239, a second side edge 241, perforated attachment edge or line 242 and a distal edge 243. Perforated attachment line 242 is substantially parallel with tuck flap score 232. Attachment 238 includes an instructions section 244 and a labels section 246. Instructions section 244 includes indicia indicative of forming sheet material 200 into a cover 201 for boxes containing beverages and is defined at least by one of the first and second side edges 239 and 241 of detachable attachment 238, a portion 245 of the perforated attachment edge or line 242 and a portion 247 of distal edge 243. Instructions section 244 also includes indicia indicative of bar code information, distribution information, brand name information and other types of information essential for product distribution. Labels section 246 includes a plurality of labels 248 and is defined at least by the other of the first and second side edges 239 and 241 of detachable attachment 238, a remaining portion 249 of the perforated attachment edge or line 242 and a remaining portion 251 of distal edge 243. Labels 248 are coupled to each other and to instructions section 244 at label perforation lines 250.

Upon detaching attachment 238 at perforated attachment line 242, labels 248 can be detached from instructions section 244. Each label 248 can be written on by a user for the purpose of adding text to cover 201. In one embodiment, label 248 can include text that indicates the beverage type for the beverage in the box that sheet material 200 will cover. As discussed in the illustration in FIG. 1, labels 248 can indicate a particular variety of wine. In another embodiment, each label 248 can be written on to include a message. Regardless of what type of information is related on labels 248, each label can be inserted into a pair of label die cuts 252 located on front panel 214. Although label die cuts 252 are illustrated as half circle cuts in sheet material 200, label die cuts 252 can take any geometrical form. As mentioned in FIG. 1, front panel 214 can have any number of die cuts as long as label 248 can be held in place on front panel 214. As illustrated in the embodiment of FIG. 7, detachable attachment 238 includes five labels 248 in label section 246. However, it should be realized that any number of labels can be formed in label section 246 of attachment 238 as long as the position of die cuts 252 conforms to the size of labels 248.

Front panel 214 of sheet material 200 includes a spigot opening 262. Spigot opening 262 is defined by spigot opening edges, such as a top edge 264 and a pair of side edges 266. Side edges 266 are substantially perpendicular or intersecting with bottom edge 220 and top edge 264 is a radial edge that couples the side edges 266 together.

Top panel 224 of sheet material 200 includes handle openings 254 and 255 for accessing a handle located on a box containing a beverage. Handle opening 254 is defined by a first handle die cut 256 and handle opening 255 is defined by a second handle die cut 258. It should be understood that handle openings 254 and 255 are one example embodiment and other forms of handle openings are possible.

As also illustrated in the embodiment of FIG. 7, sheet material 200 includes a glue flap 268, a first inner flap 270 and a second inner flap 272. Glue flap 268 is coupled to back panel 210 at first score 202. Glue flap 268 is configured for receiving an adhesive so back panel 210 can be assembled into a position adjacent second side panel 218. In particular, side panel free edge 216 should come into alignment with first score 202 when glue flap 268 is adhesively attached to the interior of side panel 218. It should be realized that in the alternative, glue flap 268 can be coupled to a different one of panels 212, 214 and 218 depending on the particular layout of sheet material 200. For example, glue flap 268 can be coupled to second side panel 218 at side panel free edge 216 so second side panel 218 can be adhesively assembled into a position adjacent back panel 210.

Figure 8:
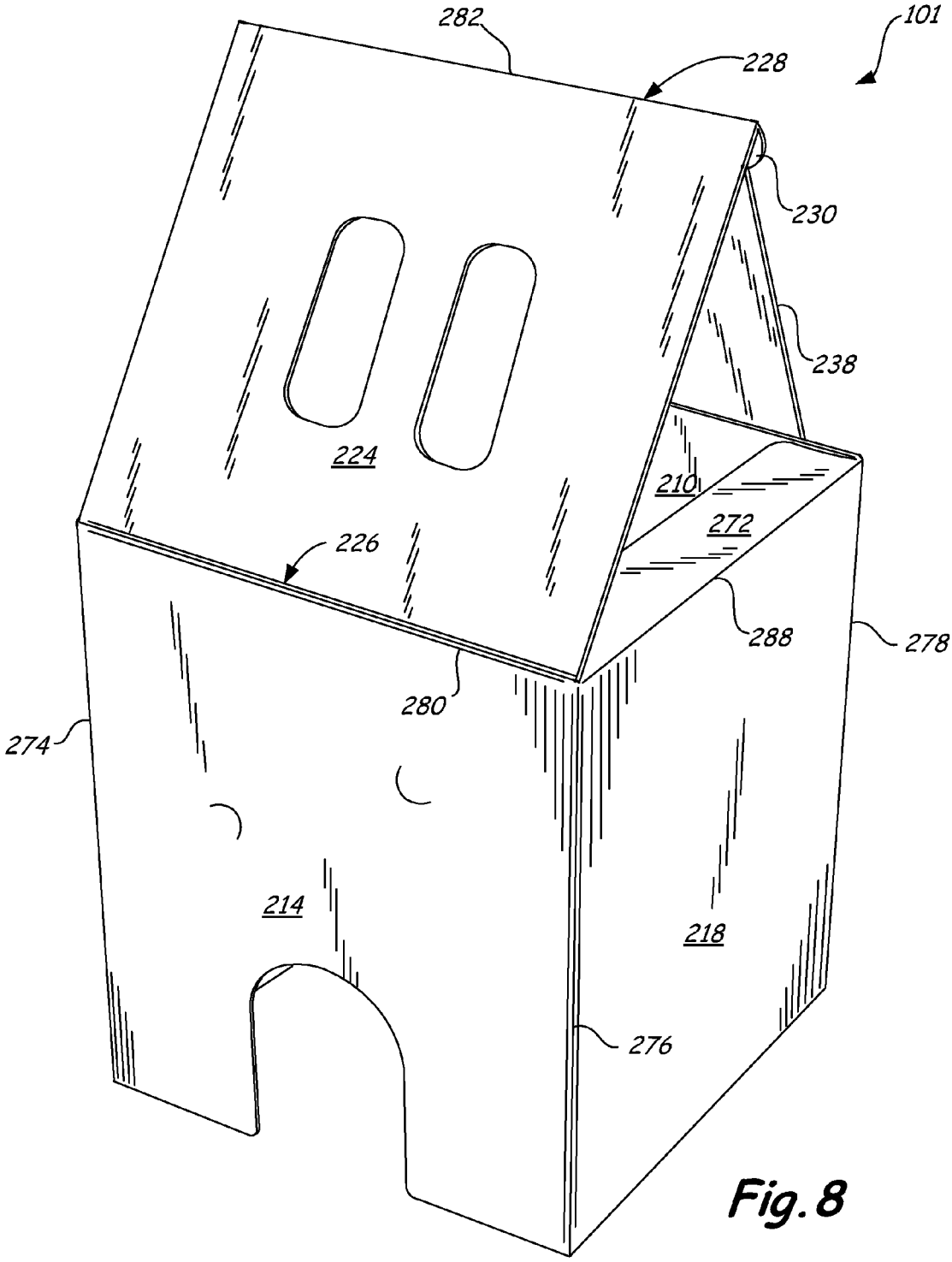
FIG. 8 illustrates a perspective view of the cover as partially formed with the sheet material illustrated in FIG. 7.
Figure 9:
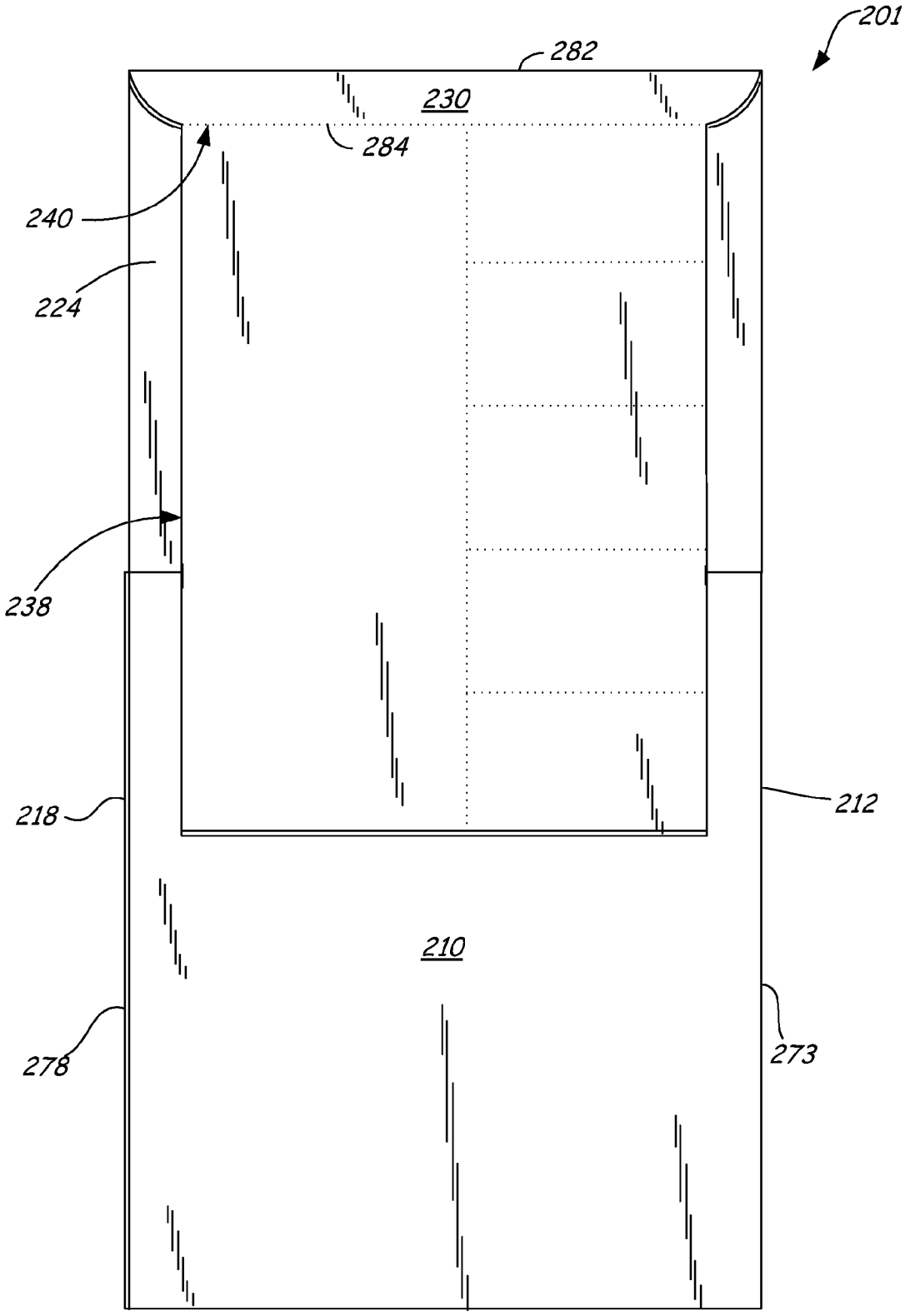
FIG. 9 illustrates a back view of the cover as illustrated in FIG. 8.

FIGS. 8 and 9 illustrate a perspective view and a back view, respectively, of a cover 201 for a box containing a beverage under one embodiment. More particularly, FIGS. 8 and 9 illustrate a cover 201 for box wine. In FIGS. 8 and 9, cover 201 is formed from sheet material 200 in a partially assembled state. Cover 201 includes front panel 214 (FIG. 8) and opposing back panel 210 (FIGS. 8 and 9) and second side panel 218 (FIGS. 8 and 9) and an opposing first side panel 212 (FIG. 9). First side panel 212 and opposing second side panel 218 couple back panel 210 to front panel 214. When sheet material 200 is folded at second score 204 (FIG. 7), a second score edge 273 (FIG. 9) is formed. When sheet material 200 (FIG. 7) is folded at third score 206 (FIG. 7), a third score edge 274 (FIG. 8) is defined. When sheet material 200 is folded at fourth score 208 (FIG. 7), a fourth score edge 276 (FIG. 8) is defined. When glue flap 268 (FIG. 7) is folded at first score 202 (FIG. 7) and adhesively coupled second side panel 218, a first score edge 278 (FIGS. 8 and 9) is defined.

Cover 201 includes top panel 224 (FIGS. 8 and 9) configured to coordinate with front panel 214, back panel 210, first side panel 212 and second side panel 218 to enclose the top of cover 201. In FIGS. 7 and 8, fixed end 226 of top panel 224 is fixed to front panel 214 at top score 222 (FIG. 7). However, as previously indicated, top panel 224 can be fixed to a different one of the panels. When sheet material 200 (FIG. 7) is folded at top score 222, a top score edge 280 (FIG. 8) is defined. Tuck flap 230 (FIGS. 8 and 9) is fixed to tuck flap end 228 (FIG. 7) of top panel 224 at tuck flap score 232 (FIG. 7). When sheet material 200 is folded at tuck flap score 232, a tuck flap score edge 282 (FIGS. 8 and 9) is defined. Detachable attachment 238 (FIGS. 7-9) is attached to perforated end 240 (FIG. 9) of tuck flap 230 at attachment perforation line 242 (FIG. 7) to define an attachment edge 284 (FIG. 9). Upon detachment of attachment 238, perforated end 240 will have a rough edge. Features of front panel 214, top panel 224 and detachable attachment 238 were discussed in detail above in regards to FIG. 7.

Figure 10:
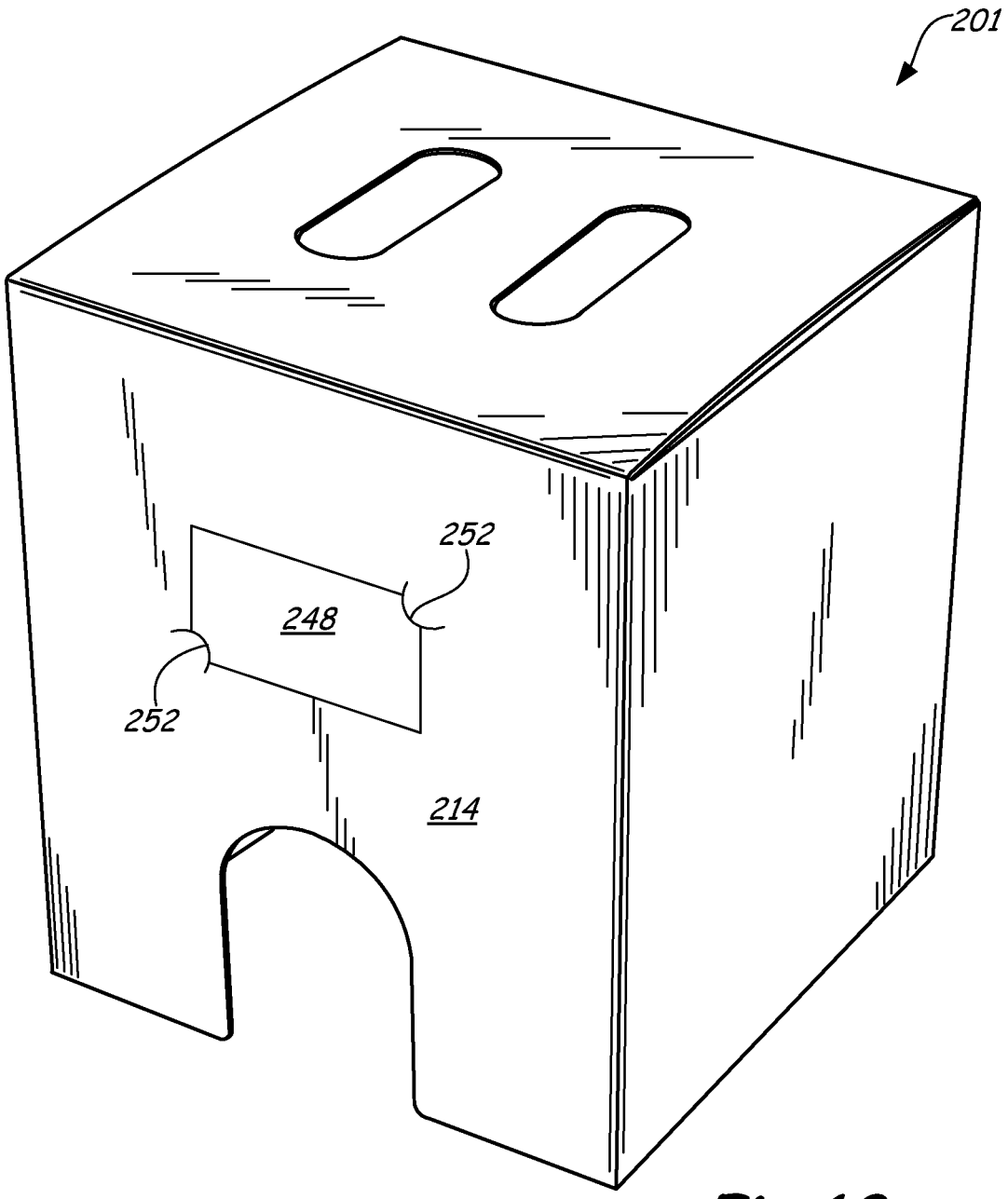
FIG. 10 illustrates a perspective view of the cover in its final formed state with the sheet material illustrated in FIG. 7.
Figure 11:
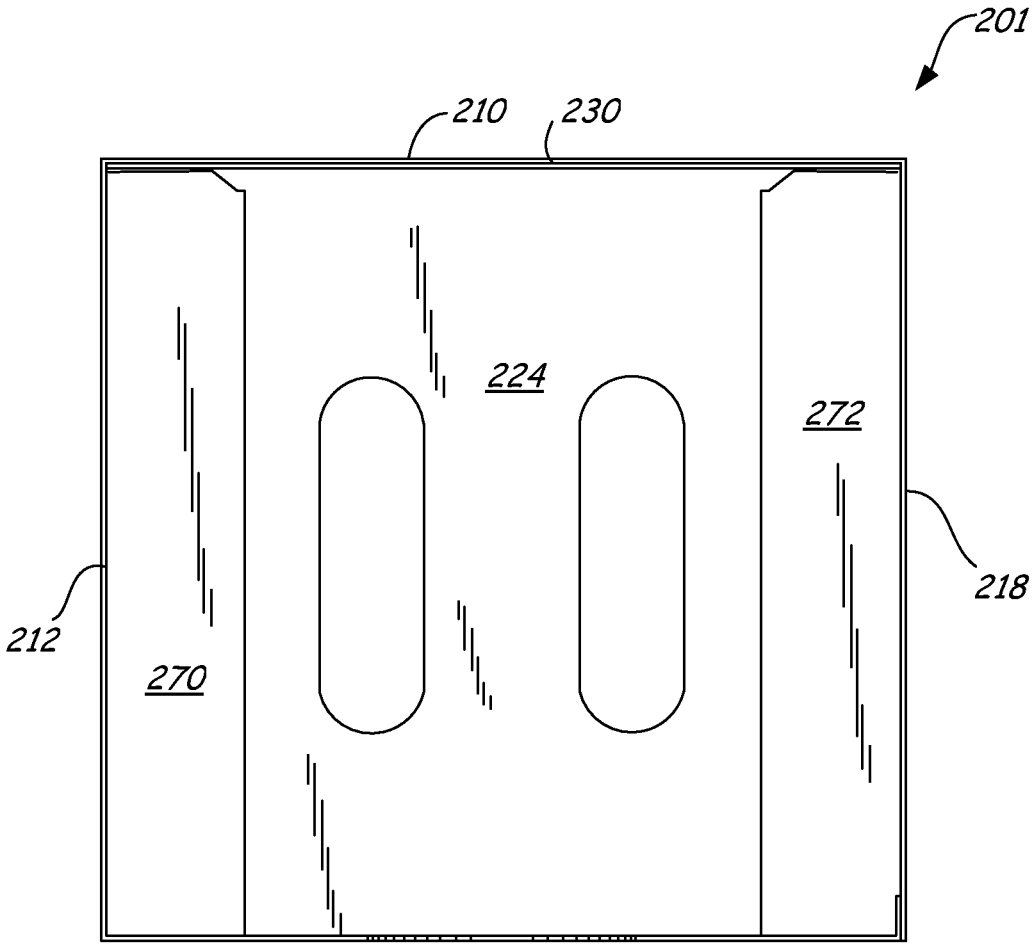
FIG. 11 illustrates a bottom view of the cover as illustrated in FIG. 10.

FIG. 10 illustrates a perspective view and FIG. 11 illustrates a bottom view of cover 201 shown in a fully assembled state forming a sleeve with a closed top and an open bottom. In FIG. 10, one of the labels 248 of detachable attachment 238 (FIG. 7) is inserted into and held in place in label die cuts 252 of front panel 214. In FIG. 11, tuck flap 230 coupled to top panel 224 is illustrated as being tucked in between first side panel 212, second side panel 218 and back panel 210. In addition, tuck flap 230 is also illustrated as being in contact with first inner flap 270 and second inner flap 272 that are coupled to first side panel 212 and second side panel 218, respectively. Tuck flap 230 is positioned in a plane perpendicular with a plane of first and second inner flaps 270 and 272.

First inner flap 270 (FIG. 7) is fixed to first side panel 212 at top edge score 222 and second inner flap 272 (FIGS. 7 and 8) is fixed to a second side panel 218 at top score 222. Tuck flap 230 interlocks with first and second inner flaps 270 and 272 to keep first side panel 212, second side panel 218, front panel 214, back panel 210 and top panel 224 in position to form a sleeve. By interlocking the first and second inner flaps 270 and 272 with tuck flap 230, the aesthetically displeasing perforated end 240 is tucked between panels of the cover and hidden from view. As previously discussed, first inner flap 270 and second inner flap 272 can be located in different positions. When sheet material 200 is folded at top score 222 adjacent first side panel 212, a first inner flap edge (hidden from view in FIGS. 8 and 9) is defined. When sheet material 200 is folded at top score 222 adjacent second side panel 218, a second inner flap edge 288 (FIG. 8) is defined.

Cover 201, formed of sheet material 200 illustrated in FIGS. 7-11, is generally configured to house a box containing about 3 liters of a beverage. While a variety of different dimensions can be utilized, example panel dimensions include a back panel 210 and front panel 214 having a width between first score 202 and second score 204 and a width between third score 206 and fourth score 208 of about 17.15 cm. Further, first side panel 212 and second side panel 218 include a width between second score 204 and third score 206 and a width between fourth score 206 and side panel free edge 216 of about 17.15 cm. A distance between top score 222 and tuck flap score 232 of top panel 224 includes about 17.15 cm while detachable attachment 238 is about 12.7 cm by 17.94 cm. Of course, as previously discussed, cover 201 formed of sheet material 200 can include other dimensions and can cover a box of a variety of different volumes.

Figure 12:
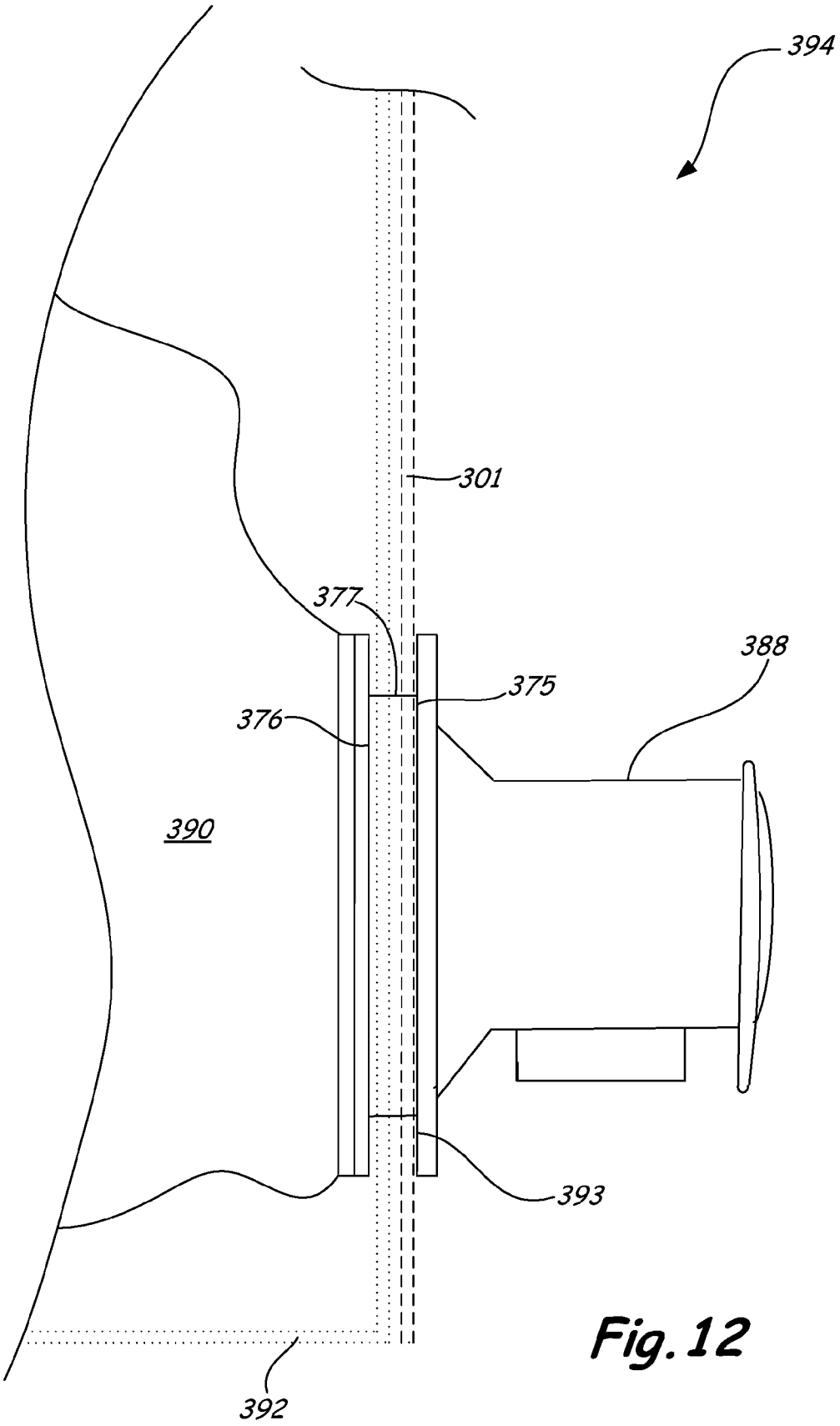
FIG. 12 illustrates an enlarged partial side view a fluid containing system under one embodiment.

FIG. 12 illustrates an enlarged partial side view of a fluid containing system 394 under one embodiment. In FIG. 12, a spigot or valve assembly 388 is coupled to a bag 390 containing a fluid. Bag 390 is a flexible container or bladder for holding a beverage or fluid. The spigot 38 and bag 390 combined can be considered a bag assembly. Spigot 388 includes a valve to control the dispensing of fluid from bag 390. Bag 390 is packaged in a box 392 (shown in dashed lines), which is covered by a cover 301 (also shown in dashed lines). As illustrated in FIG. 12, spigot 388 includes a peripheral slot or channel 393 that is defined between a front circular wall 375, a rear circular wall 376 and a cylindrical surface 377. Peripheral slot 393 is configured to accommodate at least portions of edges of box 392 to hold spigot 388 in place. Peripheral slot 393 is also configured to accommodate at least portions of edges of cover 301. Accommodating edges of cover 301 adds support to spigot 388 as well as secures cover 301 about box 392 and therefore bag 390.

Figure 13:
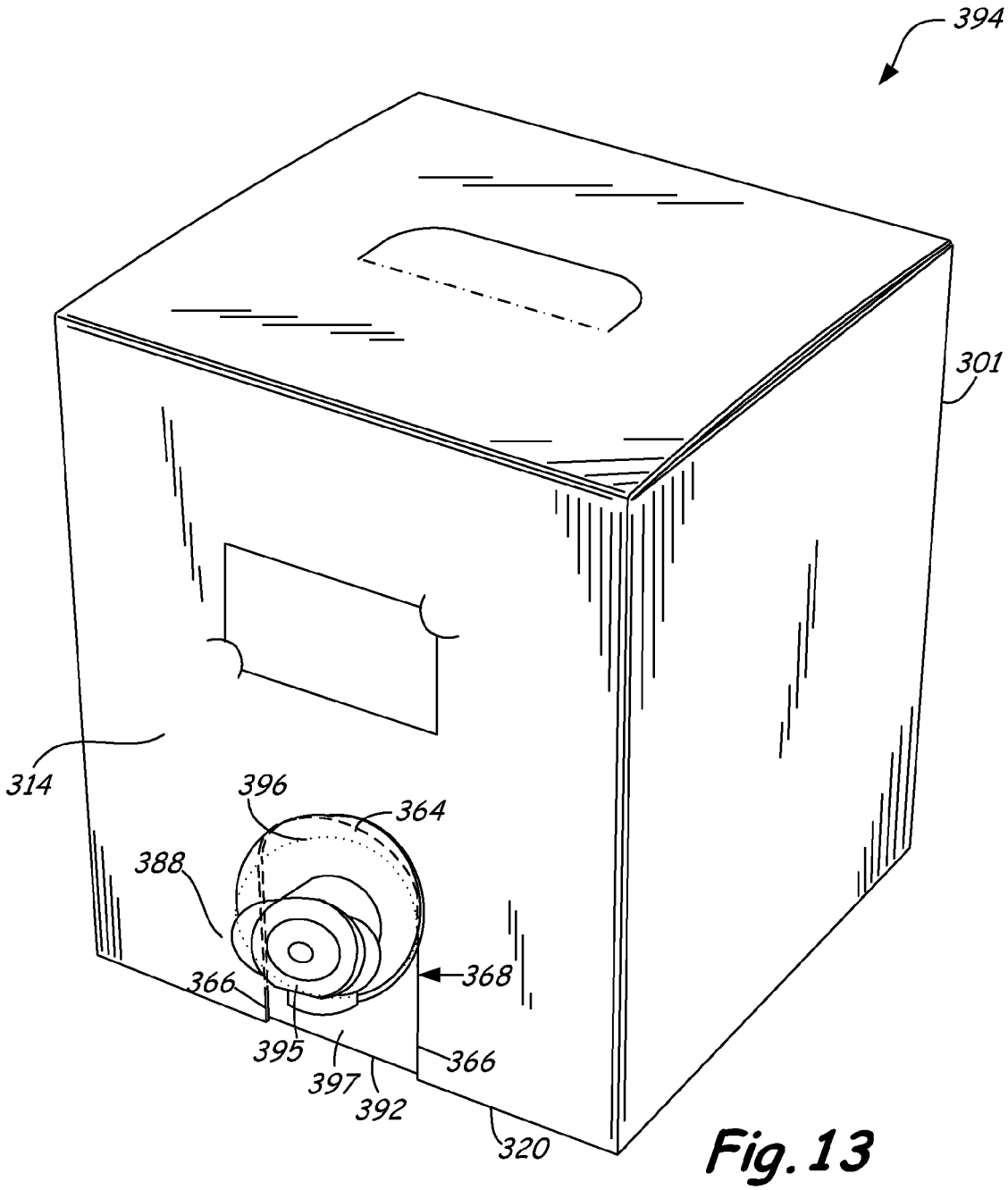
FIG. 13 illustrates a perspective view of the fluid containing system of FIG. 12.
Figure 14:
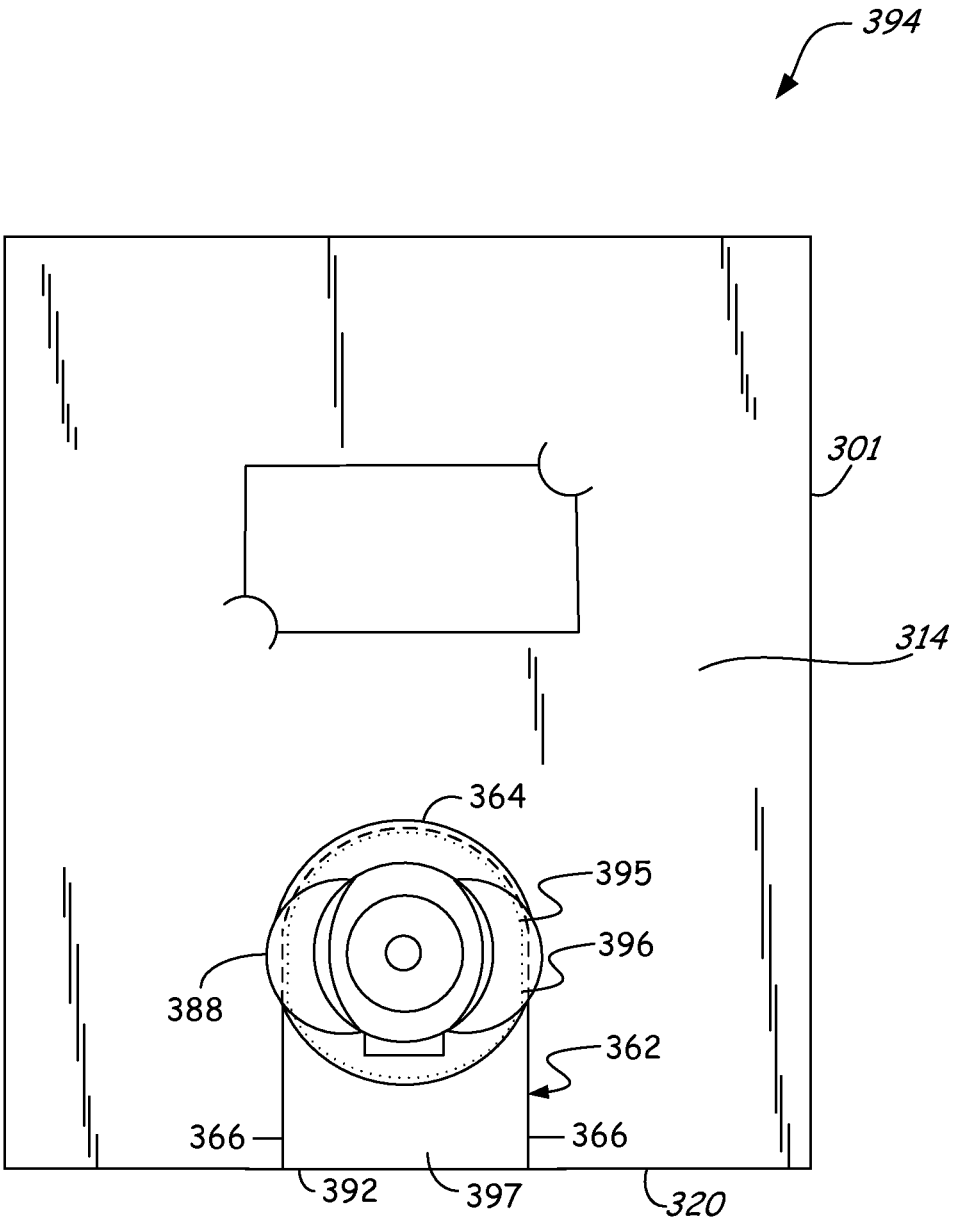
FIG. 14 illustrates a front view of the fluid containing system of FIGS. 12 and 13.

FIG. 13 illustrates a perspective view of the fluid containing system 394 of FIG. 12, while FIG. 14 illustrates a front view of the fluid containing system 394. As also shown in FIG. 12, fluid containing system 394 includes spigot 388 coupled to a bag or bladder 390 (illustrated in FIG. 12) and housed in a box 392. Fluid containing system 394 also includes a cover 301 for covering box 392. As illustrated in FIGS. 13 and 14, box 392 includes a spigot opening 395 defined by an edge 396. In some embodiments, edge 396 of spigot opening 395 is a perforated edge. During transport of fluid containing system 394, spigot 388 is also housed within box 392. To dispense fluid from system 394, spigot 388 is pulled out of box 392 through spigot opening 395 and into a position that protrudes from an outer surface 397 of the box. At least portions of edge 396 of opening 395 is inserted into the peripheral slot 393 (illustrated in FIG. 12) of spigot 388 to provide support to the spigot. It should be realized that spigot opening 395 and edge 396 can have a variety of different geometrical openings as long as spigot opening 395 allows access to spigot 388 and an edge 396 that can be utilized to secure the spigot 388.

Cover 301, which is similar to cover 101 of FIGS. 5 and 6, is placed over box 392. Front panel 314 of cover 301 includes a spigot opening 362. Spigot opening 362 is defined by spigot opening edges, such as a top edge 364 and a pair of side edges 366. Side edges 366 are substantially perpendicular to bottom edge 320 of cover 301 and top edge 364 is a radial edge that couples the side edges 366 together. At least portions of top edge 364 and side edges 366 are also inserted into the peripheral slot 393 (illustrated in FIG. 12) of spigot 388. By inserting at least portions of top edge 364 and side edges 366 into the peripheral slot 393 of spigot 388, cover 301 provides additional support to spigot 388 and cover 301 is secured to box 392.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A cover for a box that contains a bag of fluid having a spigot, the cover comprising:

a front portion;

a back portion opposing the front portion;

a pair of side portions coupling the front portion to the back portion;

a top portion fixed to the front portion at a top score edge, the top score edge defining a top edge of the front portion, the back portion and the pair of side portions;

a first inner flap fixed to and spanning across an entire width of one of the pair of side portions at the top score;

a second inner flap fixed to and spanning across an entire width of the other of the pair of side portions at the top score;

a tuck flap fixed to a tuck flap end of the top portion at a tuck flap score edge, wherein the tuck flap contacts the first inner flap and the second inner flap; and a detachable attachment coupled to a perforated end of the tuck flap at a perforated attachment edge that is parallel with the tuck flap score edge, the detachable attachment being defined by at least four edges including a first side edge, a second side edge, the perforated attachment edge and a distal edge and comprising:

an instructions section having indicia indicative of instructions for forming the cover into an assembled state, the instructions section being defined at least by one of the first and second side edges, a portion of the perforated attachment edge and a portion of the distal edge; and a labels section having a plurality of labels that are detachable from each other and from the instruction section at label perforation lines, the labels section being defined at least by the other of the first and second side edges, a remaining portion of the perforated attachment edge and a remaining portion of the distal edge.

2. The cover of claim 1, wherein the front portion comprises at least two die cuts for receiving and securing one of the plurality of labels.

3. The cover of claim 1, wherein the top portion comprises at least one handle opening for accessing a handle of the box.

4. The cover of claim 3, wherein the at least one handle opening comprises a handle flap formed by a handle die cut in the top portion.

5. The cover of claim 4, wherein the handle flap is coupled to the top portion at a handle score.

6. The cover of claim 1, wherein the front portion comprises an opening defined by a top edge and a pair of side edges, the side edges being perpendicular to a bottom free edge of the front portion, at least parts of the top edge and the side edges of the opening being constructed for insertion into a peripheral slot of the spigot, the peripheral slot of the spigot defined between a front circular wall and a rear circular wall, each of the front and rear circular walls protruding from a cylindrical surface of the spigot.

7. A sheet material formable into a cover for a box containing a flexible container of fluid, the sheet material comprising:

a first score;

a second score spaced apart from and substantially parallel with the first score such that the second score and the first score define a back panel;

a third score spaced apart from and substantially parallel with the second score such that the third score and the second score define a first side panel;

a fourth score spaced apart from and substantially parallel with the third score such that the fourth score and the third score define a front panel, the front panel including at least two die cuts;

a side panel free edge spaced apart from and substantially parallel with the fourth score such that the side panel free edge and the fourth score define a second side panel;

a top score substantially perpendicular to the first, second, third and fourth scores and the panel free edge to define a top edge of at least one of the back panel, the first side panel, the front panel and the second side panel;

a top panel directly fixed to the front panel at the top score and including a length that extends from the top score to a flap score, wherein the flap score is in parallel with the top score;

a tuck flap coupled to a flap end of the top panel at the flap score;

a first inner flap fixed to and spanning across an entire width of one of the first side panel and the second side panel at the top score, wherein the first inner flap includes a length that extends from the top score to a first inner flap free edge, the length of the first inner flap being less than the length of the top panel;

a second inner flap fixed to and spanning across an entire width of the other of the first side panel and the second side panel at the top score, wherein the second inner flap includes a length that extends from the top score to a second inner flap free edge, the length of the second inner flap being less than the length of the top panel; and an instructions set coupled to a perforated end of the tuck flap at a perforation, the perforation being in parallel with the flap score, wherein the instruction set includes an instruction section having indicia indicative of instructions for forming the sheet material into an assembled state and a labels section including a plurality of labels that are detachable from each other and from the instruction section at label perforation lines;

wherein the at least two die cuts formed in the front panel receive and secure one of the plurality of labels; and wherein the tuck flap is configured to contact the first inner flap and the second inner flap when the sheet material is formed into the cover for the box.

8. The sheet material of claim 7, wherein the front panel comprises an opening having a top edge and a pair of side edges that intersect a bottom free edge of the front panel, at least portions of the top edge and the side edges of the opening being inserted into a peripheral channel of a valve assembly coupled to the flexible container of fluid, the peripheral channel of the valve assembly defined between a front circular wall and a rear circular wall, each of the front and rear circular walls protruding from a cylindrical surface of the valve assembly.

9. The apparatus of claim 7, wherein the instruction set is defined by at least four edges including a first side edge, a second side edge, the perforated attachment edge and a distal edge.

10. The apparatus of claim 9, wherein the instruction section is defined at least by one of the first and second side edges, a portion of the perforated attachment edge and a portion of the distal edge and wherein the labels section is defined at least by the other of the first and second side edges, a remaining portion of the perforated attachment edge and a remaining portion of the distal edge.

11. A cover for a box that holds a bag assembly having a bag and a spigot, the cover comprising:

a front panel;

a back panel opposing the front panel;

a pair of side panels coupling the front panel to the back panel, wherein a first side panel of the pair of side panels has a top end that includes a first inner flap that extends across an entire width of the first side panel and a second side panel of the pair of side panels has a top end that includes a second inner flap that extends across an entire width of the second side panel;

a top panel having a fixed end coupled to a top of the front panel and having a free end that includes a tuck flap that extends across an entire width of the top panel, wherein the tuck flap is configured to contact the first inner flap and the second inner flap when the sheet material is formed into the cover for the box;

a bottom free edge defining at least a bottom edge of the front panel; and an opening including a top edge and a pair of side edges, the pair of side edges formed perpendicular to and intersecting with the bottom free edge of the front panel, at least portions of the top edge and the side edges of the opening being configured for insertion into a peripheral slot of the spigot and positioned adjacent to edges of the box.

12. The cover of claim 11, further comprising:

an attachment coupled to a perforated attachment edge of the tuck flap.

13. The cover of claim 12, wherein the attachment comprises an instructions section including instructions for forming the sheet material into an assembled state and a labels section including at least one label that is detachable from the instructions section.

14. The cover of claim 13, wherein the front panel comprises at least two die cuts for receiving and securing one of the labels.

15. A sheet material formable into a cover for a box containing fluid that is accessed through a spigot, the sheet material comprising:

a front portion defined in part by a bottom free edge;

a back portion opposing the front portion;

a pair of side portions coupling the front portion to the back portion;

a top portion fixed to the front portion at a top score edge, the top score edge defining a top of the front portion, a top of the back portion and a top of the pair of sides portions;

a first inner flap fixed to and spanning across an entire width of one of the pair of side portions at the top score edge;

a second inner flap fixed to and spanning across an entire width of the other of the pair of side portions at the top score edge;

a tuck flap fixed to a tuck flap end of the top portion at a tuck flap score edge, wherein the tuck flap contacts the first inner flap and the second inner flap; and an opening defined by a radial edge and a pair of side edges in the front portion, the pair of side edges formed perpendicular to and intersecting with the bottom free edge of the front portion, at least portions of the radial edge and the side edges of the opening being sized to fit within a peripheral slot of the spigot to secure the cover and to stabilize the spigot.

16. The sheet material of claim 15, further comprising:

a detachable attachment coupled to a perforated end of the tuck flap.

17. The sheet material of claim 16, wherein the detachable attachment comprises at least one label that is detachably attached to the detachable attachment by at least one label perforation line.

18. The sheet material of claim 17, wherein the front portion comprises at least one cut for receiving and securing a label.

19. An apparatus comprising:

a cover for a box having a fluid-containing bladder coupled to a spigot, the cover comprising:

a front panel, a back panel and two side panels coupling the front panel to the back panel;

a bottom free edge defining the bottom of the front panel, the back panel and the two side panels;

a top panel having a fixed end coupled to a top of the front panel;

a first inner flap fixed to and spanning across an entire width of one of the pair of side panels;

a second inner flap fixed to and spanning across an entire width of the other of the pair of side panels;

a tuck flap coupled to the free end of the top panel, wherein the tuck flap contacts the first inner flap and the second inner flap; and a top edge and a pair of side edges that together define an opening in the front panel, the pair of side edges are perpendicular to and intersecting with the bottom free edge of the front panel, wherein the opening is configured such that the top edge fits within a peripheral channel in the spigot and is positioned adjacent to edges of the box.

20. The apparatus of claim 19, wherein the cover further comprises:

a label coupled to the tuck flap at a perforated attachment edge.

21. The apparatus of claim 20 further comprising instructions coupled to the tuck flap at the perforated attachment edge, the instructions providing directions for erecting the cover.

22. The apparatus of claim 19, wherein the front panel of the cover comprises at least two die cuts for receiving and securing a label.

23. The apparatus of claim 19, wherein the top panel of the cover comprises at least one handle opening for accessing a handle of the box.

* * * * *